United States Patent [19]

Kojima

[11] Patent Number: 4,466,741

[45] Date of Patent: Aug. 21, 1984

[54] MIXING ELEMENT AND MOTIONLESS MIXER

[76] Inventor: Hisao Kojima, 3-53-21, Shioiri-cho, Tsurumi-ku, Yokohama-shi, Japan

[21] Appl. No.: 454,283

[22] Filed: Dec. 29, 1982

[30] Foreign Application Priority Data

| | | | |
|---|---|---|---|
| Jan. 16, 1982 | [JP] | Japan | 57-4023 |
| Jan. 26, 1982 | [JP] | Japan | 57-9596 |
| Apr. 12, 1982 | [JP] | Japan | 57-59796 |
| Oct. 9, 1982 | [JP] | Japan | 57-176988 |

[51] Int. Cl.[3] ..... B01F 5/00

[52] U.S. Cl. ..... 366/339; 138/37; 138/39

[58] Field of Search ..... 48/189.4; 138/37, 39, 138/42, 115; 252/359; 366/183, 338, 339

[56] References Cited

U.S. PATENT DOCUMENTS

| | | | |
|---|---|---|---|
| 3,424,437 | 1/1969 | Shearer | 366/339 |
| 3,930,485 | 1/1976 | Konomi | 366/338 |
| 3,953,002 | 4/1976 | England, Jr. | 366/339 |

FOREIGN PATENT DOCUMENTS

| | | |
|---|---|---|
| 2262016 | 6/1974 | Fed. Rep. of Germany . |
| 7733456 | 11/1978 | Fed. Rep. of Germany . |
| 2355556 | 1/1978 | France . |

*Primary Examiner*—Robert W. Jenkins
*Assistant Examiner*—Arthur D. Dahlberg
*Attorney, Agent, or Firm*—Oblon, Fisher, Spivak, McClelland & Maier

[57] ABSTRACT

A mixing element for a motionless mixer comprises a passage tube through which fluids flow and a helical blade formed in the passage tube so as to be integral therewith. The interior of the passage tube is partitioned by the blade to form a plurality of fluid passages. The blade extends from one end of the passage tube to the other in the longitudinal direction of the passage tube to be twisted helically clockwise (right-handed) or counterclockwise (left-handed). The corner portions of the fluid passages are rounded. The end edges of the blade are curved in the direction of the thickness and rounded. The motionless mixer is formed by alternately and longitudinally coupling right- and left-handed rotation type mixing elements. The mixing elements are so arranged that the facing end edges of the blades of each two adjacent mixing elements cross at right angles.

21 Claims, 31 Drawing Figures

MIXING ELEMENT AND MOTIONLESS MIXER

BACKGROUND OF THE INVENTION

This invention relates to a mixing element for mixing two or more fluids and a motionless mixer using the same.

Motionless mixers (trademark: Static Mixers) have no mechanical moving parts and are so designed that fluids are mixed as they are passed through passages in a tube having a helical blade therein. The motionless mixers of this type are used in various fields, such as chemical plants, food industry, environmental pollution prevention technology, etc. In a prior art motionless mixer, as shown in FIGS. 1 to 3, a plurality of helical blades 1 and 2 formed by twisting sheets left- or right-handed respectively at an angle of 180 degrees are arranged in a passage tube 3. The blades 1 and 2 are coupled and fixed so that the facing end edges of each two adjacent blades cross at right angles. Two fluids flow individually through regions in the passage tube 3 partitioned by the blades 1 or 2, and are divided and joined at the junction of the blades. Then, the fluids flow helically, and are divided and joined at the next junction. After such division, joining, and transfer are repeated, the two fluids are mixed thoroughly.

Conventionally, the helical blades 1 and 2 are manufactured by casting, and each two helical blades 1 and 2 are fixedly coupled by welding or brazing so that their facing end edges cross at right angles. Helical blades fixedly coupled are inserted into the hollow cylindrical passage tube 3. Thus, the manufacture of the motionless mixer is not easy, and the fluids may often stagnate at the junctions where the adhesive agent is swollen. Owing to working errors, moreover, narrow gaps are formed between the helical blades 1 or 2 and the passage tube 3. These gaps reduce the efficiency of fluid mixing. As shown in the sectional view of FIG. 4 taken along line IV—IV of FIG. 3, the surface of the blade 1 and the inner peripheral surface of the passage tube 3 cross at substantially right angles, so that acute-angled dead spaces 4 are formed at four corner portions of the inside regions of the passage tube 3 partitioned by the blade 1. The fluids may stagnate at the dead spaces 4. Moreover, the flatness of an end edge 1*a* of the blade 1 increases the flow resistance.

FIG. 5 shows a motionless mixer with helically twisted fluid passage tubes. As shown in FIG. 6, the fluid passage of each of passage tubes 5*a* and 5*b* has a semicircular cross section. The pair of passage tubes 5*a* and 5*b* are twisted helically, and are coupled so that their boundary between passage tubes 5*a* and 5*b* crosses the boundary between their adjacent pair of similar passage tubes 6*a* and 6b at right angles at the longitudinal end portions. Since it is difficult to manufacture a pair of helically twisted tubes, the manufacturing cost of this motionless mixer is high.

SUMMARY OF THE INVENTION

An object of this invention is to provide a mixing element in which a helical blade and a fluid passage tube are formed as an integral body.

Another object of the invention is to provide a motionless mixer using mixing elements in which a helical blade and a fluid passage tube are formed as an integral body.

Still another object of the invention is to provide a motionless mixer in which fluids are prevented from stagnating.

A further object of the invention is to provide a motionless mixer reduced in flow resistance and in fluid pressure loss.

A still further object of the invention is to provide a motionless mixer improved in fluid mixing efficiency.

An additional object of the invention is to provide a motionless mixer low in manufacturing cost.

According to this invention, there is provided a mixing element for a motionless mixer without a mechanical moving part whereby two or more fluids are mixed as the fluids flow through said motionless mixer, said mixing element comprising: a passage tube through which the fluids flow; and a helical blade formed in the passage tube so as to be integral therewith, the interior of said passage tube being partitioned by said blade to form a plurality of fluid passages.

The fluids to be mixed by the motionless mixer of the invention include liquid, gas and particulates. According to the invention, the motionless mixer is so designed as to mix two or more fluids with different properties or ingredients. The properties may include, for example, viscosity and other physical properties, composition, temperature, color, particle size, etc. The motionless mixer can produce liquid-gas mixtures, as well as liquid-liquid mixtures and gas-gas mixtures. In some cases, the fluids may undergo a chemical reaction as they are mixed in the motionless mixer.

BRIEF DESCRIPTION OF THE DRAWINGS

FIGS. 11 to 17 show motionless mixers according to various other embodiments of the invention, in which FIGS. 11, 13 and 15 are perspective views for illustrating the way the motionless mixers are assembled by coupling the mixing elements, and FIGS. 12, 14, 16 and 17 are side views showing the assembled motionless mixers;

FIGS. 25 to 27 show motionless mixers according to various other embodiments of the invention, in which FIG. 25 is a perspective view for illustrating the way the motionless mixer is assembled by coupling the mixing elements, and FIGS. 26 and 27 are side views showing the assembled motionless mixers;

DETAILED DESCRIPTION OF THE PREFERRED EMBODIMENTS

Figure 1:
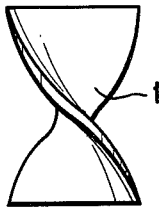
FIG. 1 PRIOR ART
FIGS. 1 to 3 are schematic views showing a prior art motionless mixer.
Figure 2:
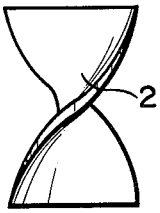
FIG. 2 PRIOR ART
Figure 3:
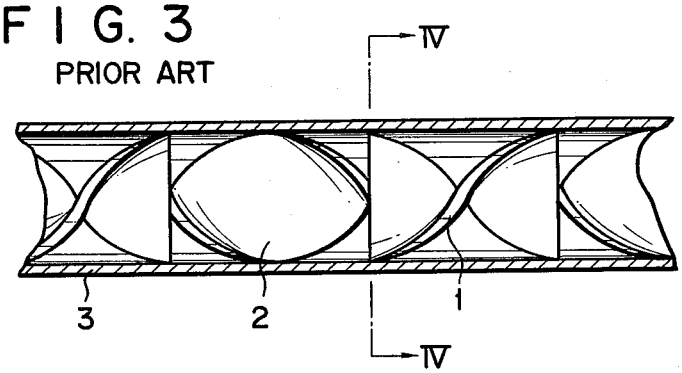
FIG. 3 PRIOR ART
Figure 4:
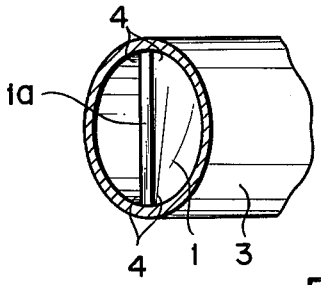
FIG. 4 PRIOR ART
FIG. 4 is a sectional view taken along line IV—IV of FIG. 3.
Figure 6:
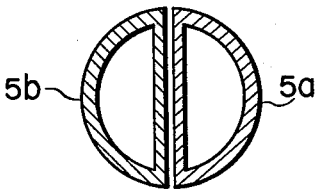
FIG. 6 PRIOR ART
FIG. 6 is a sectional view of the motionless mixer of FIG. 5.
Figure 5:
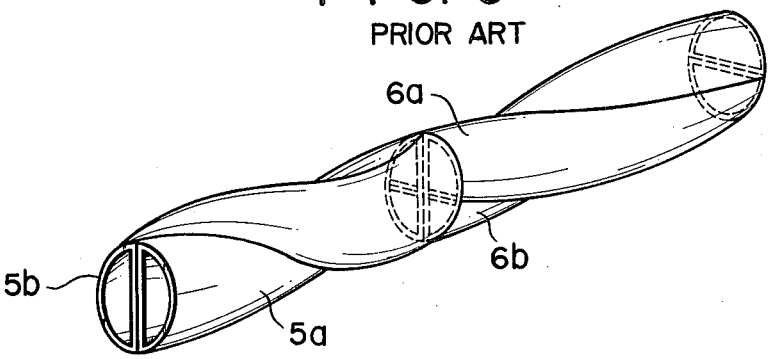
FIG. 5 PRIOR ART
FIG. 5 is a schematic view of another prior art motionless mixer with helically twisted passage tubes.
Figure 7:
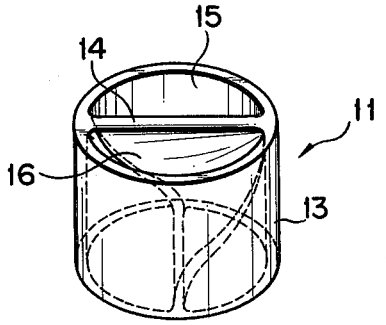
FIG. 7 is a perspective view of a right-handed 90-degree-rotation type mixing element according to one embodiment of this invention.
Figure 8:
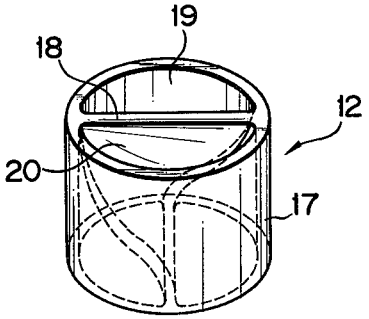
FIG. 8 is a perspective view of a left-handed 90-degree-rotation type mixing element according to one embodiment of this invention.

FIGS. 7 and 8 show mixing elements 11 and 12, respectively, of a 90-degree-twist type according to one embodiment of this invention. The mixing element 11 comprises a cylindrical passage tube 13 and a helical blade 14 therein. The blade 14 is twisted clockwise (right-handed) at 90 degrees, extending from one end portion of the mixing element 11 to the other along the longitudinal direction of the element 11. The mixing element 12 comprises a cylindrical passage tube 17 and a helical blade 18 therein. The blade 18 is twisted counterclockwise (left-handed) at 90 degrees, extending from one end portion of the mixing element 12 to the other along the longitudinal direction of the element 12. The blade 14 or 18 and its corresponding passage tube 13 or 17 respectively are formed as an integral body. The mixing elements are made of plastic or a metal, such as aluminium, magnetic or non-mangetic stainless steel, nickel, magnetic or non-magnetic iron, copper, or titanium. Fluid passages 15 and 16, partitioned by the blade 14 and turned helically clockwise are formed in the passage tube 13 of the mixing element 11. Fluid passages 19 and 20 which, partitioned by the blade 18 and turned helically counterclockwise are formed in the passage tube 17 of the mixing element 12. Those sections of the fluid passages 15, 16, 19 and 20 which are perpendicular to the flow direction are each in the form of a semicircle along the whole passage region.

Figure 9:
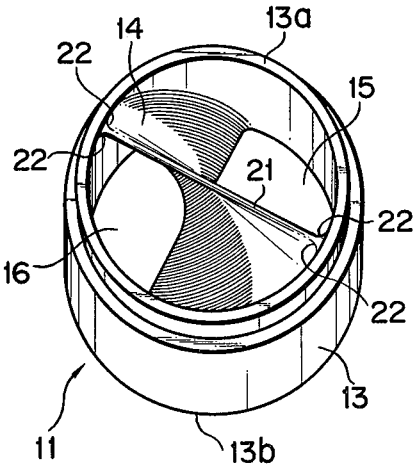
FIG. 9 is an enlarged perspective view of the mixing element shown in FIG. 7.
Figure 10:
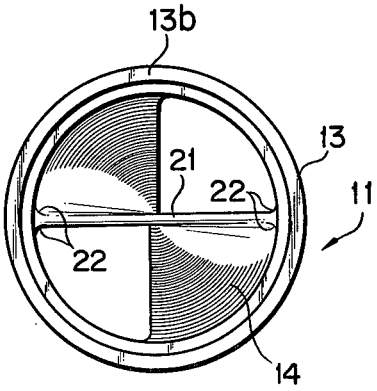
FIG. 10 is an enlarged bottom view of the mixing element of FIG. 7.

FIG. 9 and 10 are an enlarged perspective view and an enlarged bottom view, respectively, of the mixing element 11. Both end faces 21 of the blade 14 opposed in the longitudinal direction of the mixing element 11 are curved in the direction of the thickness and rounded. A pair of corner portions 22 of each of the fluid passages 15 and 16 are rounded lest the inner peripheral surface of the passage tube 13 and the surface of the blade 14 should cross at an acute angle. One end face of the passage tube 13 has an inner annular projection 13*a* while the other end face has an outer annular projection 13*b*. Likewise, both end faces of the blade 18 of the mixing element 12 and the four corner portions of the fluid passages 19 and 20 are rounded. Also, both end faces of the passage tube 17 have the same annular projections as those of the passage tube 13.

Since the passage tubes 13 and 17 and their corresponding blades 14 and 18 of the mixing elements 11 and 12 are integral, no gap is formed between each blade and the inner peripheral surface of its corresponding passage tube. Moreover, the mixing elements 11 and/or 12 are coupled by fixing the passage tubes 13 and/or 17 together, so that it is unnecessary to fix the blades by welding or brazing. Therefore, fluid never stagnates at the junctions of the mixing elements. Since the blades need not be bonded to one another, it is unnecessary to flatten the end faces of the blades 14 and 18. Thus, the end faces of the blades 14 and 18 can be rounded so that the flow resistance of the fluid may be lowered. Since the corner portions of the fluid passages 15, 16, 19 and 20 are rounded, there is no dead space, and the fluid flowing through the passages is prevented from stagnating at the corner portions.

Figure 11:
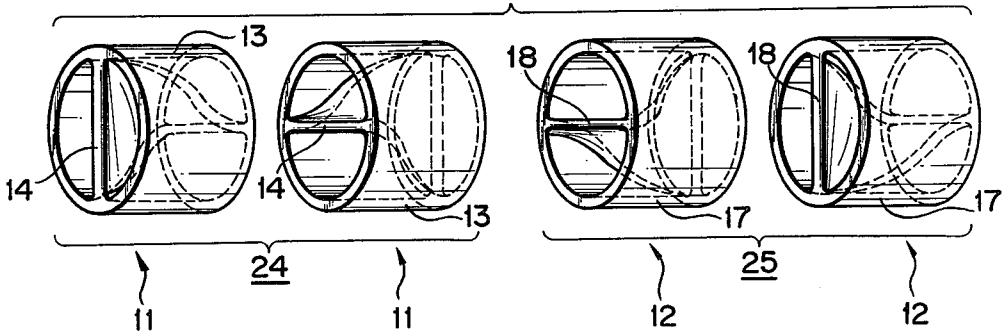
Figure 12:
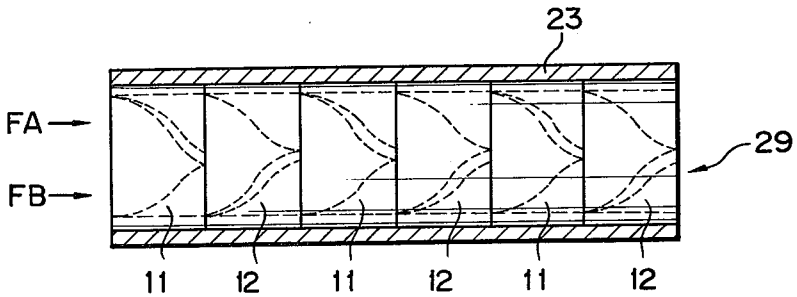

A motionless mixer using the mixing elements 11 and 12 will now be described. As shown in FIG. 11, the first element 11 and the second element 12 are positioned with their blades 14 and 18 crossing at right angles. The inner annular projection of the passage tube 17 of the element 12 is fitted in the outer annular projection 13*b* of the passage of the element 11. (Alternatively, the inner annular projection 13*a* may be fitted in the outer annular projection of the element 12.) The second element 12 and the third element 11 (not shown) are posited in the same way as the first element 11 and the second element 12, with the inner annular projection of the passage tube of the third element 11 fitted in the outer annular projection of the passage tube 17 of the second element 12. (Alternatively, the inner annular projection of the passage tube 17 of the second element 12 may be fitted in the outer annular projection of the passage tube of the third element 11.) The third element 11 and the fourth element 12 (neither one shown) are coupled in the same manner as the first element 11 and the second element 12, and the fourth element 12 and the fifth element 11 (not shown) are coupled in the same manner as the second element 12 and the third element 11, and so forth. The passage tubes of all the mixing elements 11 and 12 are welded or brazed, thus forming a motionless mixer. Alternatively, they may be fitted in a cylindrical casing 23 as shown in FIG. 12, thus forming a motionless mixer 29.

The motionless mixer 29 mixes two fluids FA and FB in the following manner. The fluids FA and FB rotate 90° in a helically right-handed manner as they flow through the first mixing element 11. The fluids FA and FB branch each into two streams at the junction of the first element 11 and the second element 12. One of the two streams of fluid FA thus mixes with one of the streams of fluid FB as it flows through the second element 12. Similarly, the other stream of fluid FA mixed with the other stream of fluid FB as it flows through the second element 12. Two fluid mixture streams rotate 90° in helically left-handed manner as they pass through the second mixing element 12. These fluid mixture streams branch each into two sub-streams at the junction of the second element 12 and the third element 11. One of the sub-streams of one of the fluid mixture streams mixes with one of the sub-streams of the other fluid mixture streams. Likewise, the other sub-stream of the first fluid mixture stream mixes with the other sub-stream of the other fluid mixture stream. In similar manner the fluids FA and FB are further mixed as they enter and flow through the other mixing elements 11 and 12. Whenever the fluids FA and FB rotate 90°, they undergo a vortex motion and thus mixed together. As they rotate, branch and join several times while flowing through the mixing elements 11 and 12, they are thoroughly mixed to form a homogeneous fluid.

Figure 13:
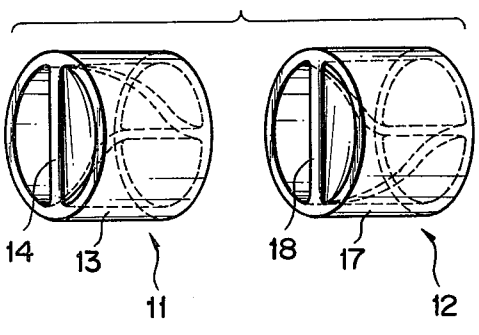
Figure 14:
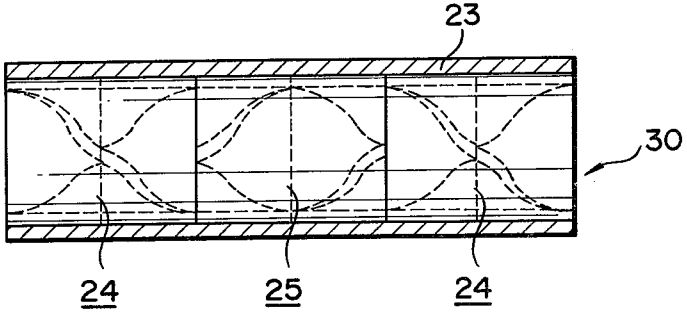

A motionless mixer 30 shown in FIG. 14 is formed by coupling the mixing elements 11 and 12, as shown in FIG. 13. A mixing unit 24 is formed by coupling a pair of mixing elements 11 so that the facing end edges of their blades 14 are arranged in the same direction. Likewise, a mixing unit 25 is formed by coupling a pair of mixing elements 12 so that the facing end edges of their blades 18 are arranged in the same direction. In the motionless mixer 30, the mixing units 24 and 25 are arranged in the casing so that the facing end edges of the blades 14 and 18 are crossed at right angles.

In the motionless mixer 30, the fluids rotate helically right-handed at 180 degrees while they flow through the mixing unit 24. After the fluids are divided and joined at the junction of the mixing units 24 and 25, they rotate helically left-handed at 180 degrees as they flow through the mixing unit 25. Thus, in this motionless mixer 30, the fluids are mixed thoroughly after this process is repeated several times.

Figure 15:
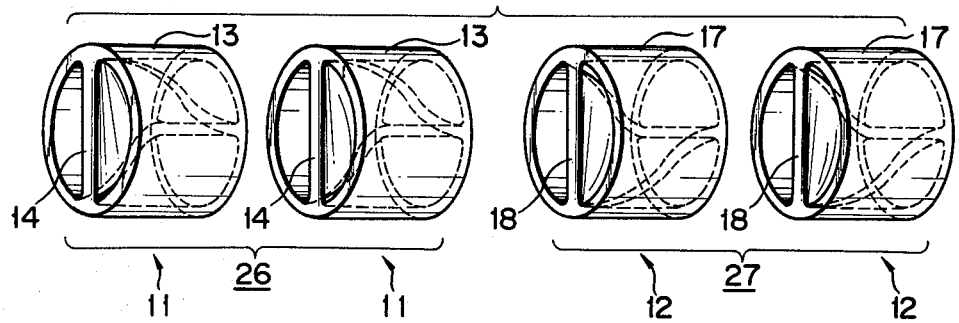
Figure 16:
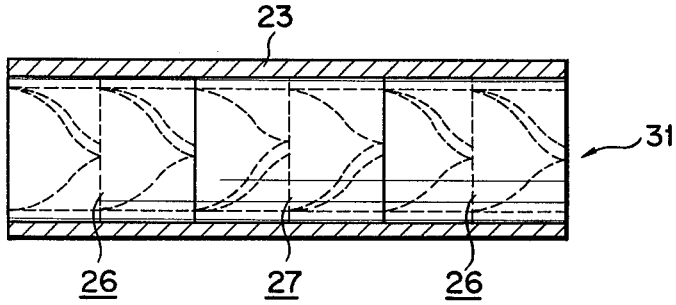

A motionless mixer 31 shown in FIG. 16 is assembled by coupling the mixing elements 11 and 12 as shown in FIG. 15. A mixing unit 26 is formed by coupling a pair of mixing units 11 so that the facing end edges of their blades 14 cross at right angles. Likewise, a mixing unit 27 is formed by coupling a pair of mixing elements 12 so that the facing end edges of their blades 18 cross at right angles. In the motionless mixer 31, the mixing units 26 and 27 are arranged alternately in the casing 23 so that the facing end edges of the blades 14 and 18 cross at right angles at their junctions.

In the motionless mixer 31, as the fluids flow through the mixing unit 26, they rotate helically right-handed at 90 degrees, are then divided and joined, and further rotate helically right-handed at 90 degrees. The fluids are then divided and joined at the junction of the mixing units 26 and 27. Then, as the fluids flow through the mixing unit 27, they rotate helically left-handed at 90 degrees, are then divided and joined, and rotate helically left-handed at 90 degrees. Thus, the two fluids are mixed thoroughly after the rotation, division, and joining are repeated several times while they flow through the motionless mixer 31.

Figure 17:
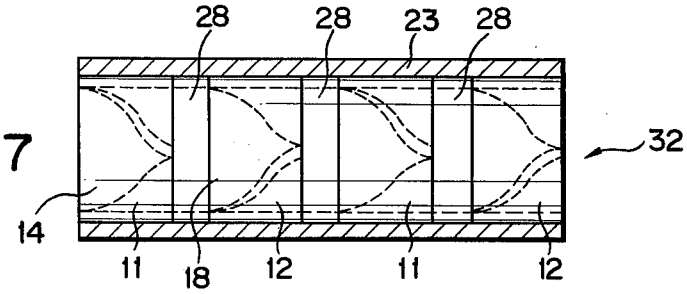

In a motionless mixer 32 shown in FIG. 17, the mixing elements 11 and 12 are arranged alternately in the casing 23 with cylindrical spacer members 28 interposed between them. The mixing elements 11 and 12 are so arranged that those facing end edges of the blades 14 and 18 which adjoin one of the spacer members 28 at each side cross at right angles.

In the motionless mixer 32, the fluids rotate helically right-handed at 90 degrees as they flow through the mixing element 11, and then join at the spacer members 28. Once joined, the fluids are divided by the mixing element 12, and then rotate helically left-handed at 90 degrees. Thus, the fluids are mixed thoroughly after the rotation, joining, and division are repeated several times.

These motionless mixers are easy to manufacture because their blades need not be welded or brazed to one another. In the absence of bonded portions between the blades, the fluids never stagnate. Since the motionless mixers are formed by longitudinally coupling the mixing elements, the frequency of the fluid division per unit length may readily be increased by shortening the mixing elements. In these motionless mixer, therefore, even viscous fluids can be mixed with ease.

Figure 18:
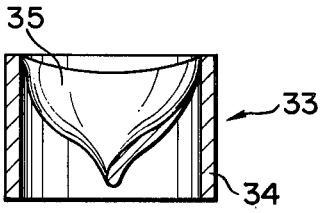
FIG. 18 is a sectional view of a right-handed 90-degree-rotation type mixing element according to another embodiment of the invention.
Figure 19:
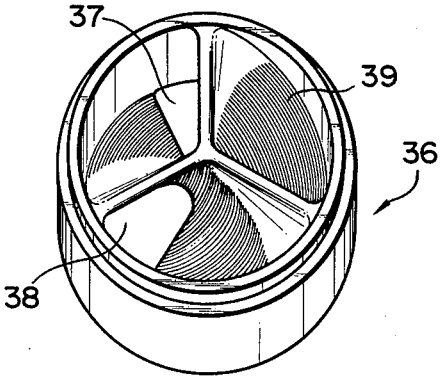
FIG. 19 is a perspective view of a 90-degree-rotation type mixing element with three fluid passages according to still another embodiment of the invention.

FIG. 18 shows a mixing element 33 in which both end edges of a blade 35 are depressed toward the center of a passage tube 34. The concave end edges of the blade 35 regularize the passage time of the fluids flowing through each mixing element 33, and can increase the efficiency of the mixing in the mixing element 33. FIG. 19 shows a mixing element 36 having three fluid passages 37, 38 and 39. This mixing element 36 can mix three fluids. When mixing two fluids only, it enjoys higher mixing efficiency.

Figure 20:
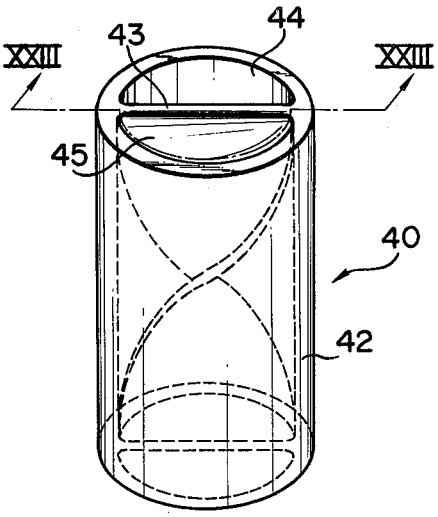
FIG. 20 is a perspective view of a right-handed 180-degree-rotation type mixing element according to a further embodiment of the invention.
Figure 21:
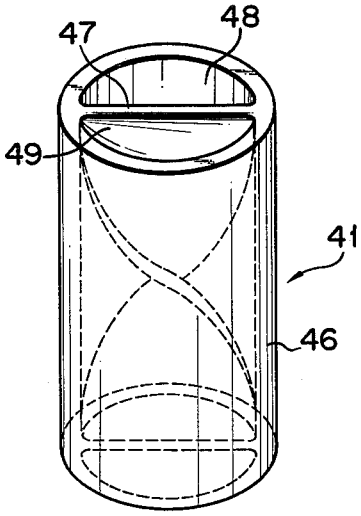
FIG. 21 is a perspective view of a left-handed 180-degree-rotation type mixing element according to an embodiment of the invention.

FIGS. 20 and 21 show mixing elements 40 and 41, respectively, of a 180-degree-twist type according to another embodiment of this invention. The mixing element 40 comprises a cylindrical passage tube 42 and a helical blade 43 therein. The blade 43 is twisted clockwise (right-handed) at 180 degrees, extending from one end portion of the mixing element 40 to the other along the longitudinal direction of the element 40. The mixing element 41 comprises a cylindrical passage tube 46 and a helical blade 47 therein. The blade 47 is twisted counterclockwise (left-handed) at 180 degrees, extending from one end portion of the mixing element 41 to the other along the longitudinal direction of the element 41. The blade 43 or 47 and its corresponding passage tube 42 or 46 respectively are formed as an integral body. Fluid passages 44 and 45, partitioned by the blade 43, and turned helically clockwise are formed in the passage tube 42 of the mixing element 40. Fluid passages 48 and 49, partitioned the blade 47 and turned helically counterclockwise are formed in the passage tube 46 of the mixing element 41. Those sections of the fluid passages 44, 45, 48 and 49 which are perpendicular to the flow direction are each in the form of a semicircular along the whole passage region.

Figure 22:
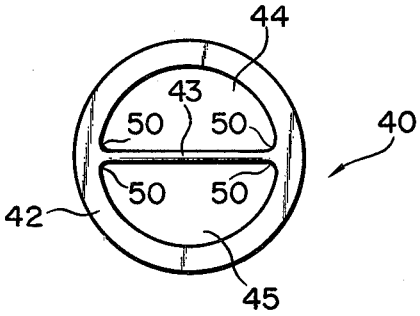
FIG. 22 is a plan view of the mixing element shown in FIG. 20.
Figure 23:
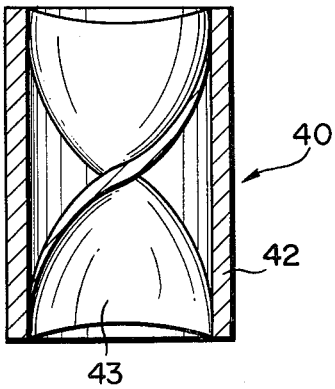
FIG. 23 is a sectional view taken along line XXIII—XXIII of FIG. 20.
Figure 24:
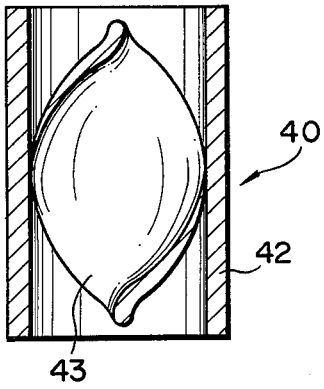
FIG. 24 is a sectional view taken along line perpendicular to the line XXIII—XXIII of FIG. 20.

Also in the mixing element 40, as shown in the plan view of FIG. 22, four corner portions 50 at the boundary between the blade 43 and the inner peripheral surface of the passage tube 42 are rounded. As seen from the sectional views of the mixing element 40 of FIGS. 23 and 24, both end edges of the blade 43 are depressed toward the central portion of the passage tube 42. The end faces of the blade 43 are rounded. In the mixing element 41, the four corner portions of the fluid passage and the end edges of the blade are formed in the same manner as those of the mixing element 40.

Figure 25:
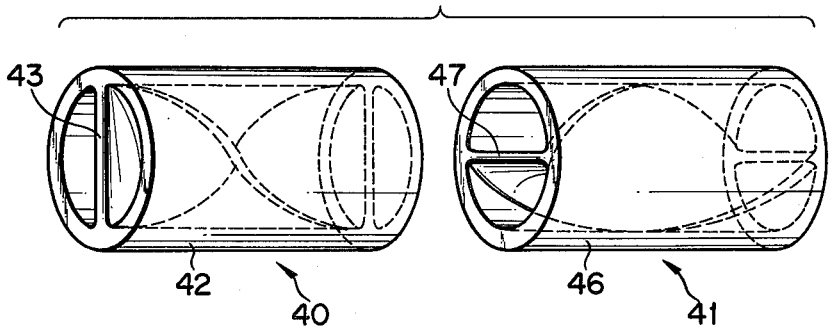
Figure 26:
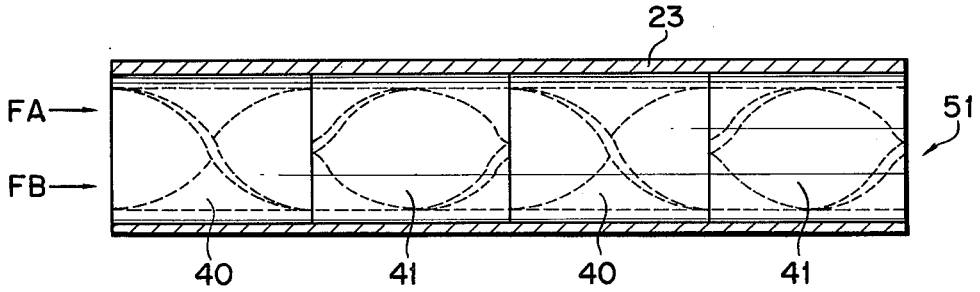

There will now be described a motionless mixer using the mixing elements 40 and 41. As shown in FIG. 25, the mixing elements 40 and 42 are arranged so that the respective end edges of their blades 43 and 47 cross at right angles. In a motionless mixer 51 shown in FIG. 26, the mixing elements 40 and 41 are fitted alternately in the casing 23. In this case, outer and inner annular projections may be formed on one and the other end faces, respectively, of each of the passage tubes 42 and 46. Thus, the mixing elements 40 and 41 may be coupled by fitting the outer annular projection of the passage tube 42 (or 46) on the inner annular projection of the passage tube 46 (or 42). In the motionless mixer 51 formed in this manner, the two fluids FA and FB rotate helically right-handed at 180 degrees as they flow through the mixing element 40. The fluids FA and FB are divided at the junction of the mixing elements 40 and 41, and then join their respective partner fluids FB and FA which are divided after separately flowing through the opposite fluid passages. Then, the divided and joined fluids rotate helically left-handed at 180 degrees as they flow through the mixing element 41. Thus, the two fluids FA and FB are mixed into a single homogeneous fluid after undergoing the 180-degree rotation, division, and joining.

Figure 27:
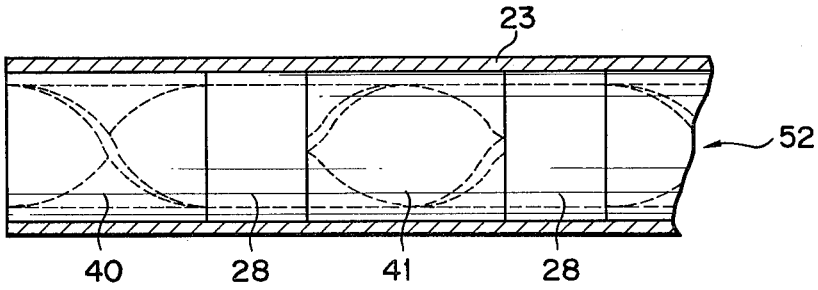

In a motionless mixer 52 shown in FIG. 27, the mixing elements 40 and 41 are arranged alternately in the casing 23 with the spacer members 28 interposed between them. In this motionless mixer 52, the fluids rotate helically right-handed at 180 degrees as they flow through the mixing element 40, and then join at the spacer members 28. Once joined, the fluids are divided by the mixing element 41, and then rotate helically left-handed at 180 degrees. Thus, the fluids are mixed thoroughly after the rotation, joining, and division are repeated several times.

Figure 28:
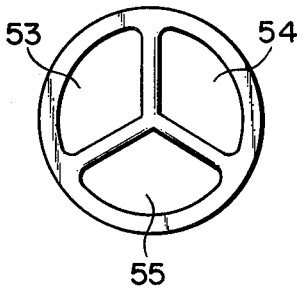
FIG. 28 is a plan view of a 180-degree-rotation type mixing element with three fluid passages according to an alternative embodiment of the invention.

The 180-degree-twist type mixing element may be also provided with three fluid passages 53, 54 and 55, as shown in the plan view of FIG. 28. The blades 43 and 47 of the mixing elements 40 and 41 need not always be so formed that their end edges are depressed toward the central portions of the passage tubes 42 and 46, or that their end faces are curved in the direction of the thickness.

The mixing elements 40 and 41 and the motionless mixer 51 and 52 provide the same effects as those of the mixing elements 11 and 12 and the motionless mixers 29, 30, 31 and 32.

Figure 29:
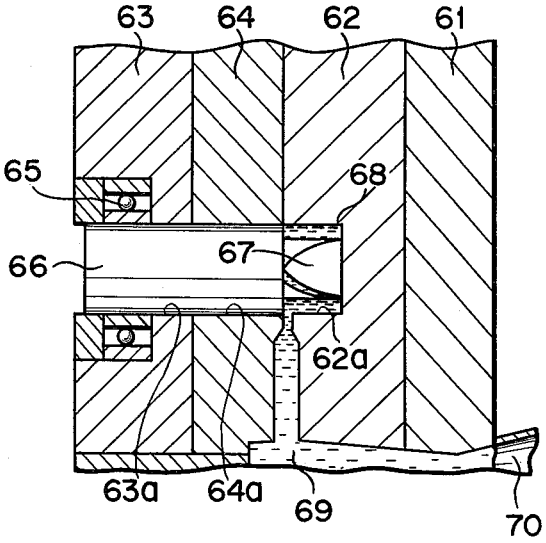
FIGS. 29 and 30 are sectional view and a perspective view, respectively, showing a molding apparatus used for injection molding of mixing elements.
Figure 30:
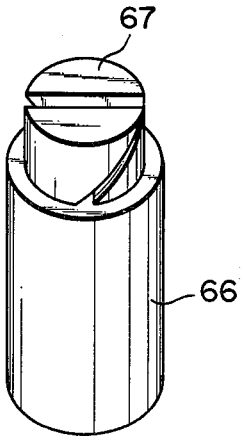

There will now be described a method and an apparatus for manufacturing the mixing element according to this invention. FIG. 29 and 30 show a mixing element casting apparatus of an injection molding type. In FIG. 29, a mounting plate 61 is fixedly erected on a suitable support, and a templet 62 is fixed to the mounting plate 61. A horizontally extending cylindrical depression 62*a* is formed in the side face of the templet 62 opposite to the mounting plate 61. A stripper plate 64 with a cylindrical hole 64*a* is put on the fixed templet 62 so that the hole 64*a* is in alignment with the depression 62*a*. A templet 63 with a cylindrical hole 63*a* moves toward and away from the fixed templet 62. The depression 62*a* and the holes 64*a* and 63*a* are equal in diameter. A bearing 65 is embedded in the templet 63 so that its inner peripheral surface is flush with that of the hole 63*a*. A core 67 for the mixing element 11 is attached to a longitudinal end portion of a cylindrical core holder 66. The core holder 66 is inserted in the holes 64*a* and 63*a* so that the core 67 is fitted in the depression 62*a*. The core holder 66 is rotatablly supported by the movable templet 63 with the aid of the bearing 65. A cavity 68 is formed between the depression 62*a* and the core 67, communicating with a molding nozzle 70 by means of a runner 69 in the mounting plates 61 and 62.

According to the casting apparatus constructed in this way, when a fused plastic material is injected into the molding nozzle 70, it flows through the runner 69 to be fed into the cavity 68. Thereupon, the cavity 68 and a helical groove of the core 67 is filled with the fused plastic. Then, the fused plastic is cooled and solidified in the cavity 68 and the helical groove. After the fused plastic is solidified, the templet 63 is moved away from the templet 62, and a plastic molding attached to the core 67 is taken out of the depression 62*a* by moving the templet 63, the stripper plate 64, the core holder 66, and the core 67 away from the templet 62. Then, when the templet 63 is separated from the stripper plate 64 while helically rotating the core holder 66 along the groove of the core 67, the molding is stripped from the core 67. Thereafter, the portions solidified in the runner 69 are trimmed off from the molding in the runner 69, and as a result, the mixing element 11 as shown in FIG. 7 is completed. Thus, the mixing element 11 with the passage tube 13 and the blade 14 formed as an integral body is readily manufactured. The other mixing elements 12, 40 and 41 may be manufactured in a like manner.

Figure 31:
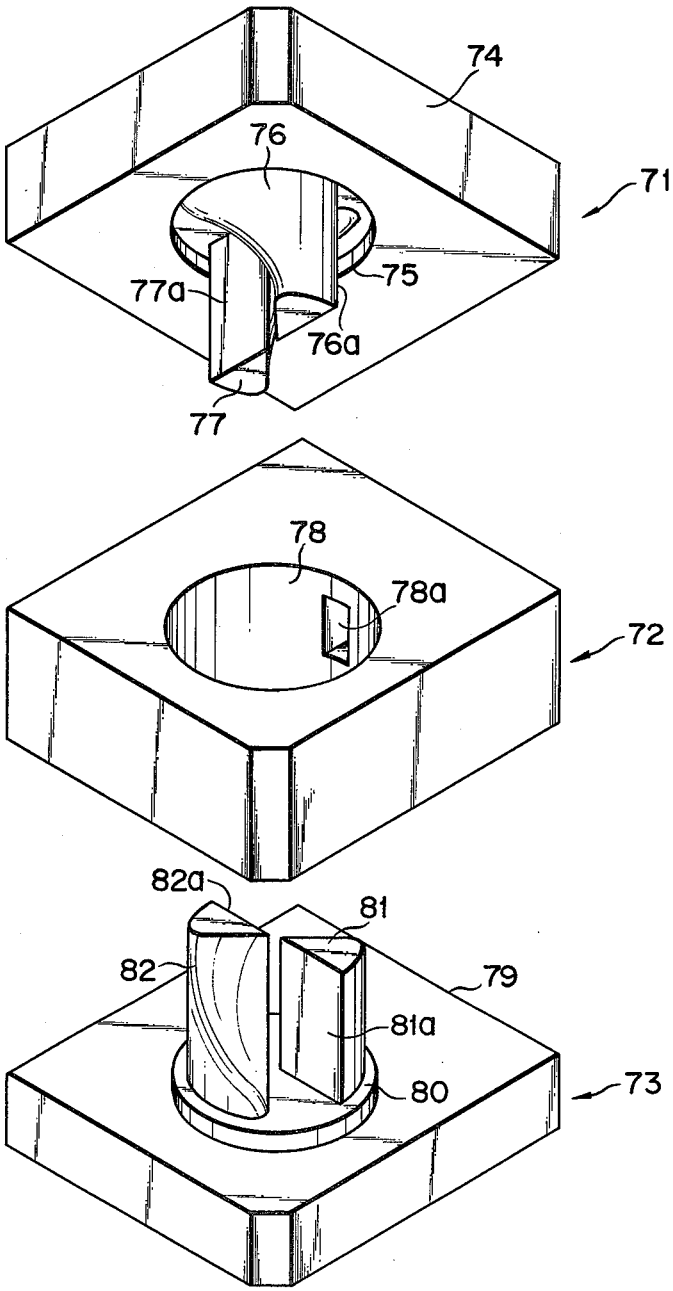
FIG. 31 is a disassembled perspective view showing a casting apparatus for mixing elements based on the lost wax investment casting method.

There will now be described a method and an apparatus for manufacturing the mixing element on the basis of the lost wax investment casting method. FIG. 31 shows a die member for casting the mixing element 12. The die member comprises upper, intermediate, and lower dies 71, 72 and 73 made of aluminum or cast iron. The upper die 71 includes a metal plate 74 and protrusions 76 and 77 projecting under the metal plate 74. A depression 75 in the form of a thin disk is bored in the lower surface of the metal plate 74. The pair of protrusions 76 and 77 in the depression 75 are so shaped as to occupy the respective halves of the fluid passages 19 and 20. The intermediate die 72 has a circular hole 78 bored across the thickness with a diameter substantially equal to the outside diameter of the mixing element, and a runner 78*a* opening into the circular hole 78. The lower die 73 includes a metal plate 79 and protrusions 81 and 82 projecting over the metal plate 79. A boss 80 in the form of a thin disk is formed on the upper surface of the metal plate 79. The protrusion 81 on the boss 80 is so shaped as to occupy the fluid passage 19 when its flat lateral face 81*a* is united with a flat lateral face 76*a* of the protrusion 76. Likewise, the protrusion 82 is so shaped as to occupy the other fluid passages 20 when its flat lateral face 82*a* is united with a flat lateral face 77*a* of the protrusion 77. The diameters of the depression 75 and the boss 80 are substantially equal, and are a little smaller than that of the circular hole 78. The upper, intermediate, and lower dies 71, 72 and 73 are assembled by fitting the protrusions 76, 77, 81 and 82 in the circular hole 78 so that the lateral faces 76*a* and 77*a* of the protrusions 76 and 77 are in contact with the lateral faces 81*a* and 82*a* of the protrusions 81 and 82, respectively. Thereupon, a portion corresponding to the blade 18 is formed between the helical lateral faces of the protrusions 76 and 82 and between those of the protrusions 77 and 81. A portion corresponding to the passage tube 17 is formed between the circumferential faces of the protrusions 76, 77, 81 and 82 and the inner peripheral surface of the circular hole 78. Also, a portion corresponding to the outer annular projection (projection 13*b* of FIG. 9) at the end face of the mixing element 12 is formed between the outer peripheral surface of the boss 80 and the inner peripheral surface of the circular hole 78, while a portion corresponding to the inner annular projection (projection 13*b* of FIG. 9) is formed between the inner peripheral surface of the depression 75 and the circumferential faces of the protrusions 76, 77, 81 and 82. When a molten material is injected into the cavity of the die member (upper, intermediate, and lower dies 71, 72 and 73) assembled in this manner, it is solidified and formed in the shape shown in FIG. 8.

There will now be described the method of manufacturing the mixing element of the invention on the basis of the lost wax investment casting method using the aforementioned split dies. First, the split dies shown in FIG. 31 are assembled in the aforesaid manner. Fused wax is injected into the cavity of the die assembly through the runner 78*a*. The injected wax is solidified to form a wax model in the shape shown in FIG. 8. A plurality of wax models are coupled so as to be fit for casting. The wax model assembly is immersed in a fire-resistant emulsion, and then covered with a sand layer by sprinkling. The immersion in the fire-resistant emulsion and the sand coating are repeated to form a layer of fire-resistant material on the surface of the wax model assembly. Then the wax model assembly is wholly heated to liquate the wax. The resultant sand mold is sintered at a high temperature. Thus, a mold having a space which corresponds to that of the mixing element is manufactured. A molten material, such as aluminum, magnetic or non-magnetic stainless steel, nickel, magnetic or non-magnetic iron, copper, or plastic, is poured into the mold. When the sintered sand mold is broken after the poured material is solidified, the 90-degree-twist type mixing element 12 as shown in FIG. 8 is produced. If the material of the mixing element is platic, the mixing element may be manufactured by directly injecting molten plastic into the split dies shown in FIG. 31 without using wax. The mixing element 11 can be manufactured in like manner.

In the manufacture of the 180-degree-twist type mixing elements 40 and 41, wax models for the 90-degree-twist type mixing elements 11 and 12 are first formed in the aforementioned manner. Then, two 90-degree-twist type wax models are longitudinally coupled and bonded together. Thus, wax models for the 180-degree-twist mixing element 40 or 41 with the shape shown in FIG. 20 or 21 is obtained. A sand mold is formed by the use of the wax models in the aforementioned manner, and a molten material for the mixing element such as aluminum is poured into the sand mold.

Thus, in the manufacture of the mixing element by the lost wax investment casting method using the split dies 71, 72 and 73, the process for fusing the core, which is needed in the conventional manufacturing method, can be omitted. Namely, the method requires fewer manufacturing processes, thus facilitating the manufacture and reducing the manufacturing cost. Moreover, the end edges 21 of the blade 14 and the corner portions 22 of the fluid passages 15 and 16, as shown in FIG. 9, may be rounded with ease. In the case where the core is used, the manufacture of the 180-degree-twist mixing element is not easy. By the lost wax investment casting method, however, the mixing element of this type can readily be manufactured by only longitudinally coupling the 90-degree-twist type wax models. It is difficult to manufacture the mixing element with three fluid passages as shown in FIG. 19 or 28 by the conventional method in which the blades are bonded by welding or brazing after they are independently formed by injection molding. According to the lost wax investment casting method, however, the mixing element with three fluid passages can be manufactured with ease.

What is claimed as new and desired to be secured by Letters Patent of the United States is:

1. A mixing element for a motionless mixer without a mechanical moving part whereby two or more fluids are mixed as the fluids flow through said motionless mixer, said mixing element comprising:

a cylindrical passage tube through which the fluids flow, said passage tube having two end faces; and a helical blade formed in the passage tube so as to be integral therewith, the interior of said passage tube being partitioned by said blade to form a plurality of fluid passages, wherein said end faces of said passage tube have outer and inner annular projections, respectively, whereby the mixing element is coupled to other mixing elements by fitting said outer and inner annular projections thereof.

2. A mixing element according to claim 1, wherein said blade is twisted helically clockwise to form fluid passages rotating helically clockwise.

3. A mixing element according to claim 2, wherein said blade extends from one end of the passage tube to the other in the longitudinal direction of the passage tube to be twisted at an angle of 90 degrees.

4. A mixing element according to claim 2, wherein said blade extends from one end of the passage tube to the other in the longitudinal direction of the passage tube to be twisted at an angle of 180 degrees.

5. A mixing element according to claim 1, wherein said blade is twisted helically counterclockwise to form fluid passages rotating helically counterclockwise.

6. A mixing element according to claim 5, wherein said blade extends from one end of the passage tube to the other in the longitudinal direction of the passage tube to be twisted at an angle of 90 degrees.

7. A mixing element according to claim 5, wherein said blade extends from one end of the passage tube to the other in the longitudinal direction of the passage tube to be twisted at an angle of 180 degrees.

8. A mixing element according to claim 1, wherein said blade divides the interior of said passage tube perpendicular to the flow direction into two parts, thereby defining two fluid passages.

9. A mixing element according to claim 1, wherein said blade divides the interior of said passage tube perpendicular to the flow direction into three parts, thereby defining three fluid passages.

10. A mixing element according to claim 1, wherein both end edges of said blade facing in the longitudinal direction of the passage tube are depressed toward the center of said passage tube.

11. A mixing element according to claim 1, wherein both end edges of said blade facing in the longitudinal direction of the mixing element are curved in the direction of the thickness of said blades and so are rounded.

12. A mixing element according to claim 1, wherein corner portions of said fluid passages in the vicinity of the boundary between said blade and the inner peripheral surface of said passage tube are rounded.

13. In a motionless mixer without a mechanical moving part, a plurality of longitudinally coupled mixing elements whereby two or more fluids are mixed as the fluids flow through said motionless mixer, each said mixing element comprising a cylindrical passage tube through which the fluids flow, and a helical blade formed in the passage tube so as to be integral therewith, said blade partitioning the interior of said passage tube to form two fluid passages, wherein said mixing elements include mixing elements of a right-handed 90-degree-rotation type twisted helically clockwise at an angle of 90 degrees, and mixing elements of a left-handed 90-degree-rotation type twisted helically counterclockwise at an angle of 90 degrees, wherein said right and left-handed 90-degree-rotation type mixing elements are arranged alternately so that facing end edges of the blades of the mixing elements cross at right angles.

14. A motionless mixer according to claim 13 which comprises a cylindrical spacer member, said right- and left-handed 90-degree-rotation type mixing elements alternately arranged with the cylindrical spacer member therebetween so that those facing end edges of the blades which adjoin said spacer member at each side cross at right angles.

15. In a motionless mixer without a mechanical moving part, a plurality of longitudinally coupled mixing elements whereby two or more fluids are mixed as the fluids flow through said motionless mixer, each said mixing element comprising a cylindrical passage tube through which the fluids flows, and a helical blade formed in the passage tube so as to be integral therewith, said blade partitioning the interior of said passage tube to form two fluid passages, wherein said mixing elements include mixing elements of a right-handed 90-degree-rotation type twisted helically clockwise at an angle of 90 degrees, and mixing elements of a left-handed 90-degree-rotation type twisted helically counterclockwise at an angle of 90 degrees, wherein a mixing unit of a right-handed rotation type is formed by longitudinally coupling two said right-handed 90-degree-rotation type mixing elements so that facing end edges of the blades of said right-handed mixing elements are in alignment with each other, a mixing unit of a left-handed rotation type is formed by longitudinally coupling two said left-handed 90-degree-rotation type mixing elements so that facing end edges of the blades of said left-handed mixing elements are in alignment with each other, and said motionless mixer is formed by alternately arranging said right- and left-handed rotation type mixing units so that the facing end edges of the blades of said mixing units cross at right angles.

16. In a motionless mixer without a mechanical moving part, a plurality of longitudinally coupled mixing elements whereby two or more fluids are mixed as the fluids flow through said motionless mixer, each said mixing element comprising a cylindrical passage tube through which the fluids flow, and a helical blade formed in the passage tube so as to be integral therewith, said blade partitioning the interior of said passage tube to form two fluid passages, wherein said mixing elements include mixing elements of a right-handed 90-degree-rotation type twisted helically clockwise at an angle of 90 degrees, and mixing elements of a left-handed 90-degree-rotation type twisted helically counterclockwise at an angle of 90 degrees, wherein a mixing unit of a right-handed rotation type is formed by longitudinally coupling two said right-handed 90-degree-rotation type mixing elements so that facing end edges of the blades of said right-handed mixing elements cross at right angles, a mixing unit of a left-handed rotation type is formed by longitudinally coupling two said left-handed 90-degree-rotation type mixing elements so that facing end edges of the blades of said left-handed mixing elements cross at right angles, and said motionless mixer is formed by alternately arranging said right- and left-handed rotation type mixing units so that the facing end edges of the blades of said mixing units cross at right angles.

17. In a motionless mixer without a mechanical moving part, a plurality of longitudinally coupled mixing elments whereby two or more fluids are mixed as the fluids flow through said motionless mixer, each said mixing element comprising a cylindrical passage tube through which the fluids flow, and a helical blade formed in the passage tube so as to be integral therewith, said blade partitioning the interior of said passage tube to form two fluid passages, wherein said motionless mixer comprises mixing elements of a right-handed 180-degree-rotation type twisted helically clockwise at an angle of 180 degrees, and mixing elements of a left-handed 180-degree-rotation type twisted helically counterclockwise at an angle of 180 degrees, wherein said right- and left-handed 180-degree-rotation type mixing elements are arranged alternately so that facing end edges of the blades of the mixing elements cross at right angles.

18. A motionless mixer according to claim 17, wherein said right- and left-handed 180-degree-rotation type mixing elements are alternately arranged with a cylindrical spacer member therebetween so that those facing end edges of the blades which adjoin said spacer member at each side cross at right angles.

19. In a motionless mixer without a mechanical moving part, a plurality of longitudinally coupled mixing elements of a right-handed-rotation type which are clockwise helically twisted and mixing elements of a left-handed-rotation type which are counterclockwise helically twisted, whereby two or more fluids are mixed as the fluids flow through said motionless mixer, each of said mixing elements comprising a cylindrical passage tube through which the fluids flow, and a helical blade formed in the passage tube so as to be integral therewith, said blade partitioning the interior of said passage tube to form three fluid passages, and said right- and left-handed-rotation type mixing elements being arranged alternately so that facing end edges of the blades cross at an angle of 60 degrees.

20. A motionless mixer according to claim 19, wherein said right- and left-handed-rotation type mixing elements twist helically at an angle of 90 degrees.

21. A motionless mixer according to claim 19, wherein said right- and left-handed-rotation type mixing elements twist helically at an angle of 180 degrees.

* * * * *